US010961081B2

(12) United States Patent
Guo

(10) Patent No.: US 10,961,081 B2
(45) Date of Patent: Mar. 30, 2021

(54) HOSE-REELING APPARATUS

(71) Applicant: Tzu-Ching Guo, Taipei (TW)

(72) Inventor: Tzu-Ching Guo, Taipei (TW)

( * ) Notice: Subject to any disclaimer, the term of this patent is extended or adjusted under 35 U.S.C. 154(b) by 0 days.

(21) Appl. No.: 16/430,367

(22) Filed: Jun. 3, 2019

(65) Prior Publication Data

US 2020/0354187 A1 Nov. 12, 2020

(30) Foreign Application Priority Data

May 6, 2019 (CN) ..... 201920636510.6

(51) Int. Cl.
*B65H 75/44* (2006.01)

(52) U.S. Cl.
CPC ..... *B65H 75/4431* (2013.01); *B65H 75/446* (2013.01); *B65H 2701/33* (2013.01); *Y10T 137/6954* (2015.04)

(58) Field of Classification Search
CPC ..... B65H 75/446; B65H 75/4478; B65H 2701/33; Y10T 137/6954
See application file for complete search history.

(56) References Cited

U.S. PATENT DOCUMENTS 3,050,078 A * 8/1962 Hooper ..... B65H 75/44 137/355.19
3,433,247 A * 3/1969 Haselden ..... B65H 75/20 137/355.26
4,506,698 A * 3/1985 Garcia ..... B65H 75/38 137/355.26
RE32,510 E * 9/1987 Tisbo ..... B65H 75/403 137/355.27
5,797,424 A * 8/1998 Tisbo ..... B65H 75/40 137/315.01
8,801,047 B2 * 8/2014 Phillips ..... B65H 75/4478 137/355.26
8,869,820 B2 * 10/2014 Arcati ..... B65H 75/403 137/355.16

* cited by examiner

*Primary Examiner* — Kevin F Murphy

(57) ABSTRACT

A hose-used hose-reeling apparatus includes a base, a reel, a conduit assembly and a communication element. The reel is supported on the base. The conduit assembly includes a conduit and a shackle. The conduit extends in the base and includes a horizontal tube and a vertical tube. The horizontal tube includes an insertion section and an abutment section. The insertion section includes at least one hook inserted in a slot in the base. The abutment section includes an end for abutment against a supporting element. The vertical tube extends in a peripheral aperture of the base from the insertion section. The shackle is movable between a releasing position disengaged from the insertion section and a locking position engaged with the insertion section. The communication element extends in the reel and covers a peripheral aperture in the insertion section as the reel is supported on the base.

12 Claims, 8 Drawing Sheets

HOSE-REELING APPARATUS

BACKGROUND OF INVENTION

1. Field of Invention

The present invention relates to a hose and, more particularly, to a hose-reeling apparatus.

2. Related Prior Art

Referring to FIG. 8, a conventional hose-reeling apparatus includes a base 91 and a reel 92. The base 91 is attached to a supporting element 50 such as a wall. The reel 92 includes a tubular body 922 formed between two end plates (not numbered). The reel 92 is supported on the base 91. In use, a hose 81 is wound on the tubular body 922 of the reel 92. The reel 92 can be detached from the base 91 so that the hose 83 can be carried or stored.

The base 91 includes a hollow axle 912. A conduit 93 is inserted in an open end of the axle 912. An end of the conduit 93 is kept in the axle 912 by an elastic clip 932. Another end of the conduit 93 is connected to a source pipe 82. The hose 81, which is wound on the tubular body 922, can be connected to a communication element 94 inserted in the tubular body 922. The communication element 94 is connected to the conduit 93 when the tubular body 922 is supported on the base 91.

Problems are encountered in the use of the conventional hose-reeling apparatus. Firstly, water supply could be choked because of reduced cross-sectional area of the source pipe 82, which is connected to the conduit 93, must be bent for an angle of 90 degrees in use.

Secondly, the hose 81 is wound on the reel 92. The total weight of the hose 81 and the reel 92 is considerable. A large force is exerted on the reel 92 and the hose 81 to locate the reel 92 on and around the base 91 and engage the communication element 94 with the conduit 93. The conduit 93, alone, bears this force during the location of the tubular body 922 of the reel 92 onto the axle 912 of the base 91. The conduit 93 is kept in the axle 912 by the elastic clip 932 only. Hence, the elastic clip 932 could easily be damaged and hence the conduit 93 could easily be detached from the axle 912. Further damage could occur. The operation is troublesome and the cost could be raised.

The present invention is therefore intended to obviate or at least alleviate the problems encountered in prior art.

SUMMARY OF INVENTION

It is the primary objective of the present invention to provide a hose with a reliable hose-reeling apparatus.

To achieve the foregoing objective, the hose-used hose-reeling apparatus includes a base, a reel, a conduit assembly and a communication element. The reel is supported on the base. The conduit assembly includes a conduit and a shackle. The conduit extends in the base and includes a horizontal tube and a vertical tube. The horizontal tube includes an insertion section and an abutment section. The insertion section includes at least one hook inserted in a slot in the base. The abutment section includes an end for abutment against a supporting element. The vertical tube extends in a peripheral aperture of the base from the insertion section. The shackle is movable between a releasing position disengaged from the insertion section and a locking position engaged with the insertion section. The communication element extends in the reel and covers a peripheral aperture in the insertion section as the reel is supported on the base.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 1:
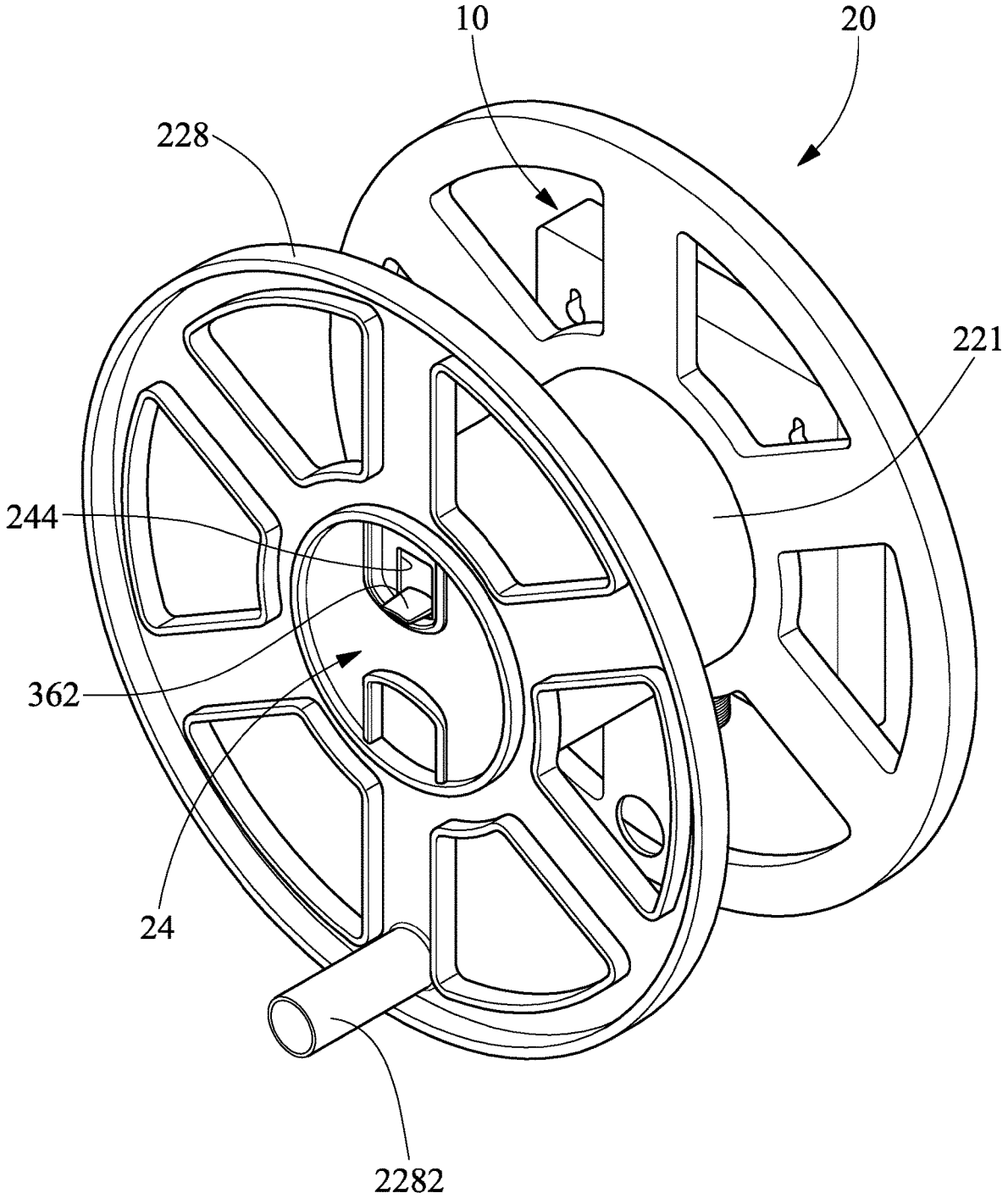
FIG. 1 is a perspective view of a hose-reeling apparatus according to the preferred embodiment of the present invention.
Figure 2:
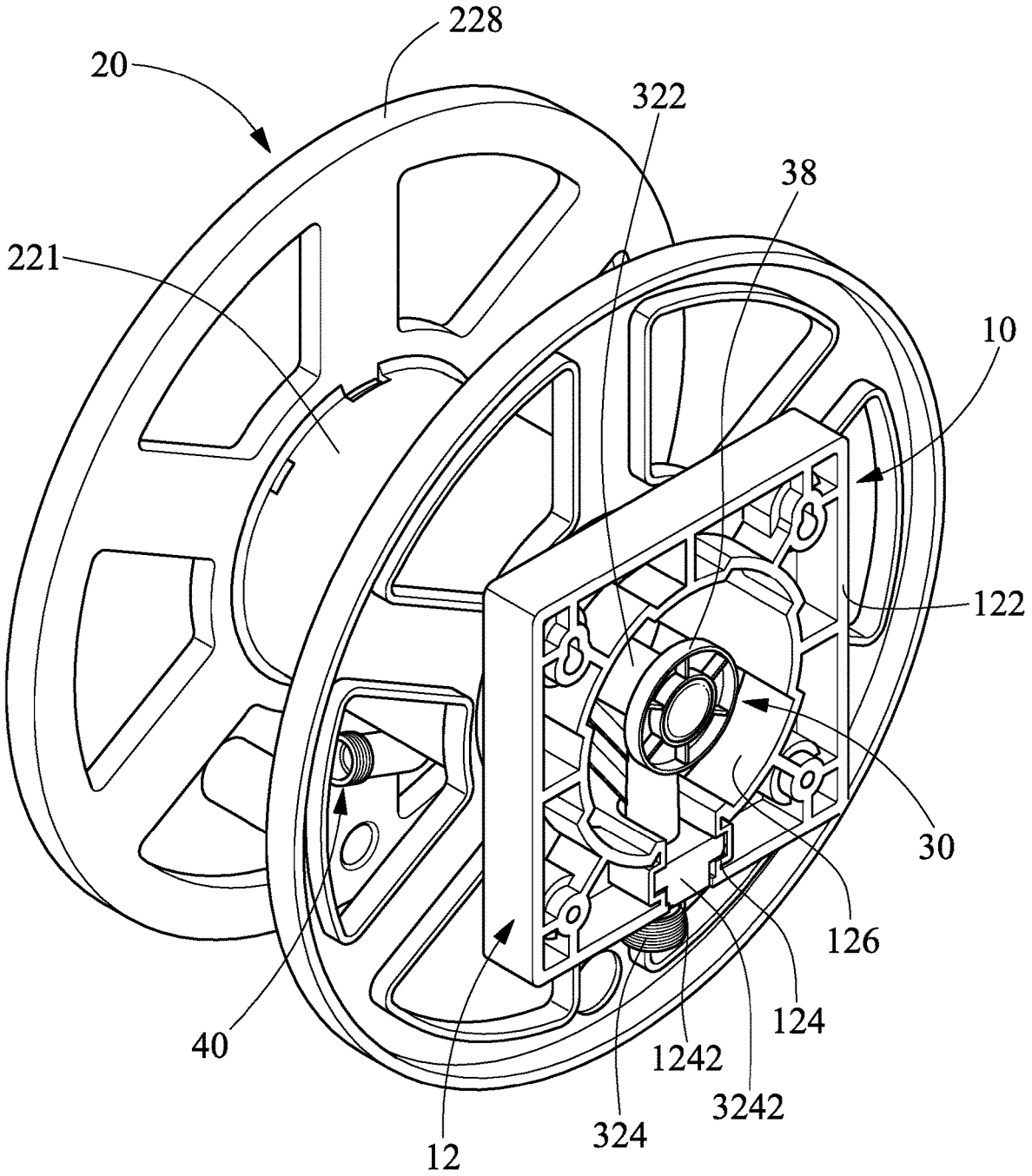
FIG. 2 is another perspective view of the hose-reeling apparatus shown in FIG. 1.
Figure 3:
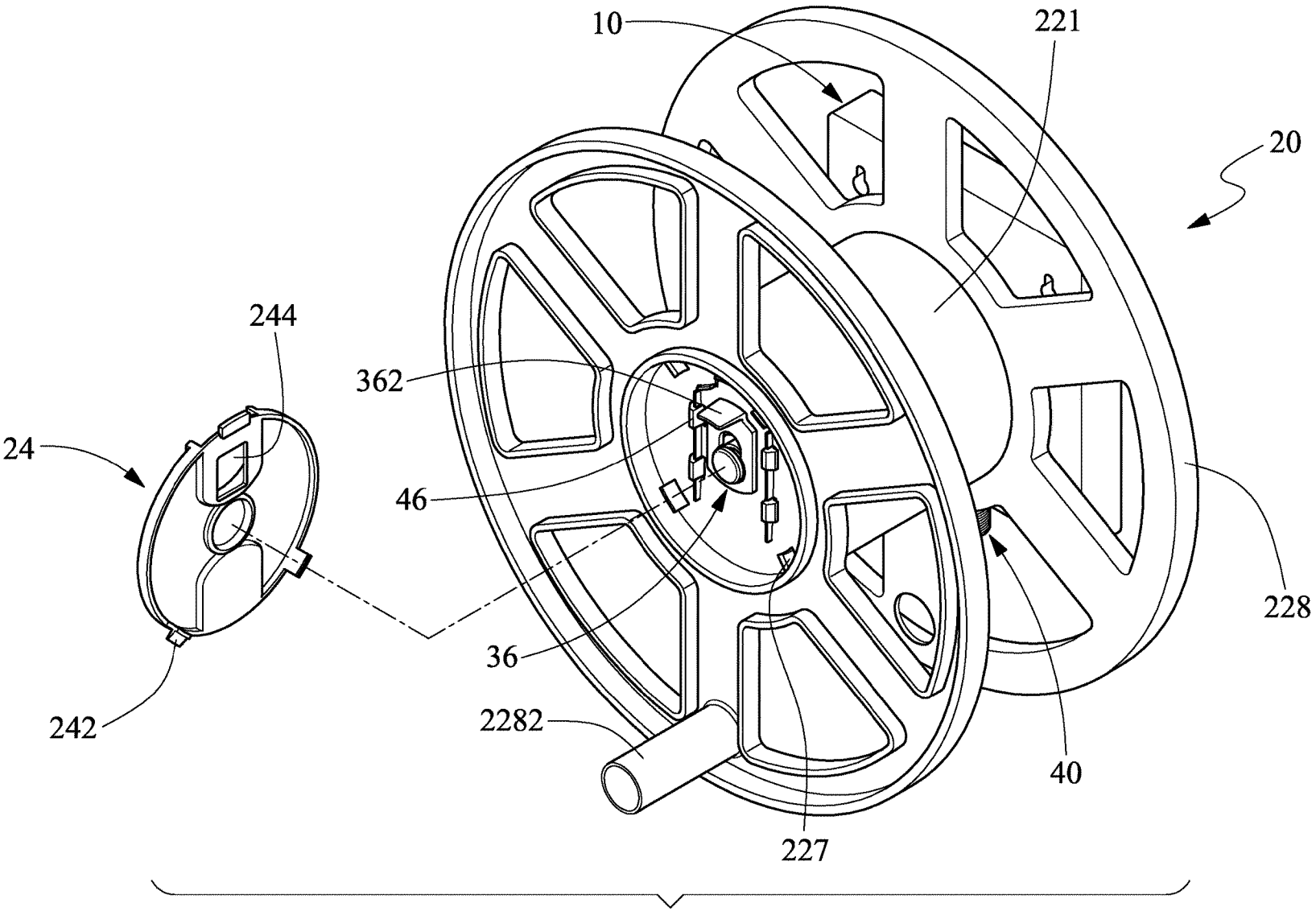
FIG. 3 is a perspective view of the hose-reeling apparatus of FIG. 1 without a cover.

Referring to FIGS. 1 through 7, a hose-reeling apparatus includes a base 10, a reel assembly 20, a conduit assembly 30 and a communication element 40 according to the preferred embodiment of the present invention.

The base 10 includes a plate 12 formed at an end of an axle 14.

The plate 12 includes a rear face 122, a dovetail recess 124 in the rear face 122, a peripheral aperture 1242 in communication with the dovetail recess 124, and an opening 126 extending axially throughout the plate 12. The plate 12 is made of proper thickness for strength.

The axle 14 includes several cantilevers 142 extending from an end disc 144 at an end and extending from a front face of the plate 12 at an opposite end. The cantilevers 142 are evenly located around the opening 126. The end disc 144 includes two slots 146 and a central aperture 148. The central aperture 148 is located between the slots 146.

The reel assembly 20 can be rotationally supported on the axle 14. The reel assembly 20 includes a reel 22 and a decorative cover 24.

Figure 4:
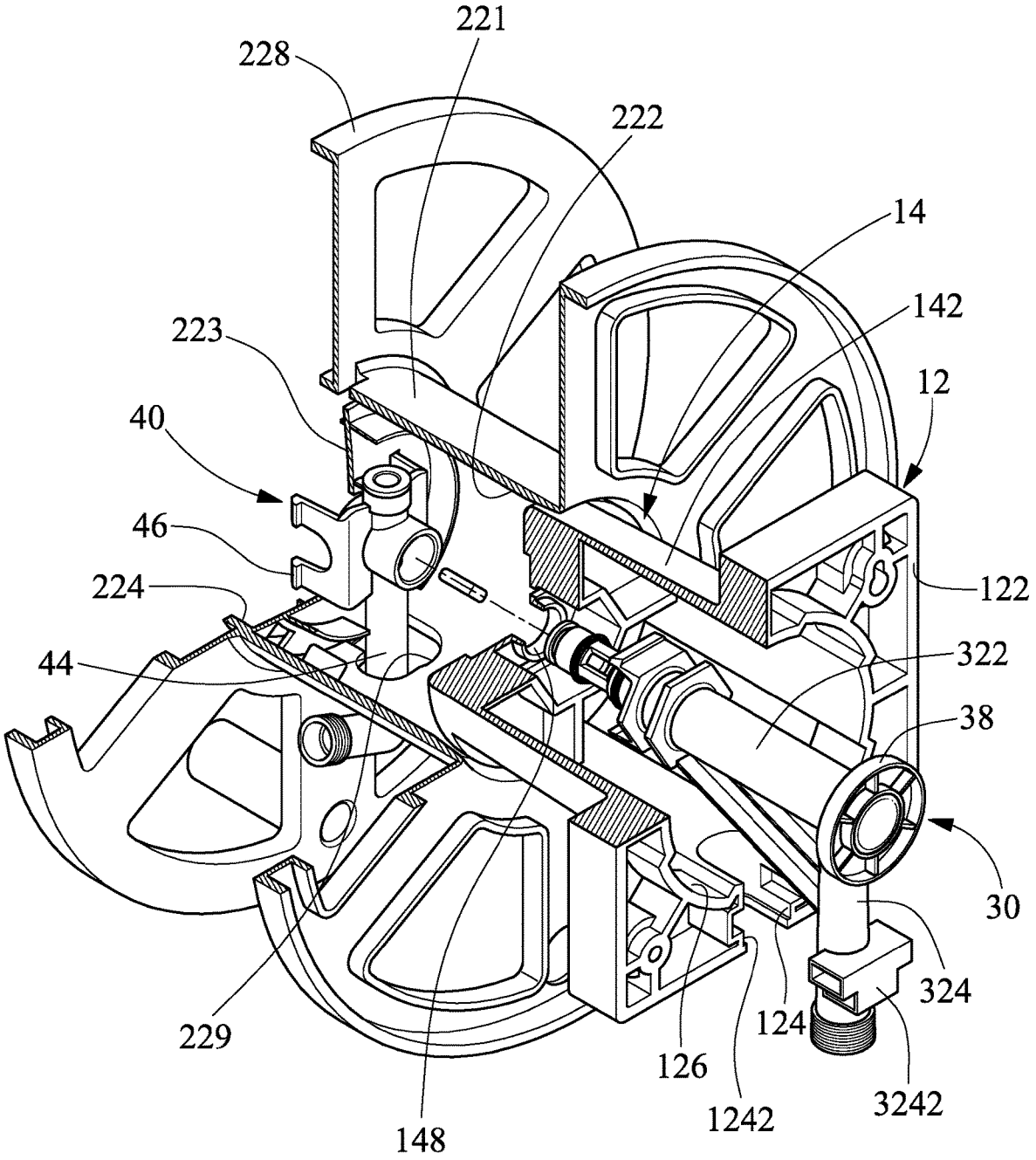
FIG. 4 is a cut-away view of the hose-reeling apparatus of FIG. 2.

The reel 22 includes a tubular body 221 formed between two annular flanges 228. The tubular body 221 includes an axial passageway 222 and a peripheral bore 229 (FIG. 4). The axial passageway 222 extends throughout the tubular body 221. The axial passageway 222 is in communication with the interior of the tubular body 221 by the peripheral bore 229.

The reel 22 is further formed with an end disc 223 at an end of the axial passageway 222. The end disc 223 includes several slots 225, a central aperture 226 and several peripheral apertures 227. The slots 225 are arranged in two rows. The central aperture 226 is located between the rows of the slots 225. The slots 225 and the central aperture 226 are located in a region defined by the peripheral apertures 227.

An operation chamber 224 is made by an annular end portion of the tubular body 221 and the end disc 223.

The reel 22 further includes a handle 2282 extending from one of the annular flanges 228. The handle 2282 is operable to rotate the entire reel 22 to wound a hose 81 on the tubular body 221.

The decorative cover 24 is used to close the operation chamber 224. To this end, the decorative cover 24 includes several buckles 242 corresponding to the peripheral apertures 227. The buckles 242 can be inserted in the peripheral apertures 227 to attach the decorative cover 24 to the end disc 223 so that the decorative cover 24 thinly closes the operation chamber 224. The decorative cover 24 further includes a window 244. The operation chamber 224 is observable through the window 244.

The conduit assembly 30 is inserted in the base 10 in use. The conduit assembly 30 includes a conduit 32, a reinforcing element 34 (FIG. 6) and a shackle 36.

The conduit 32 includes a horizontal tube 322 and a vertical tube 324. The horizontal tube 322 and the vertical tube 324 are made in one piece.

The horizontal tube 322 extends throughout the opening 126 of the plate 12 and the central aperture 148 of the end disc 144 of the axle 14 in use. The horizontal tube 322 is formed with an insertion section 3221 and an abutment section 3222 at two ends. The insertion section 3221 includes at least one peripheral aperture 3223 via which the interior of the horizontal tube 322 is in communication with the exterior of the horizontal tube 322. An annular groove 3224 is made in an external face of the insertion section 3221. The insertion section 3221 further includes hooks 3225 corresponding to the slots 146 of the end disc 144. The hooks 3225 are inserted in the slots 146 to connect the insertion section 3221 to the end disc 144 in use.

Preferably, the conduit 32 includes a contact plate 38 formed at end of the abutment section 3222. The contact plate 38 is formed with a rear face (not numbered) substantially in flush with the rear face 122 of the plate 12 in use. The contact plate 38 is used to reinforce the abutment section 3222 and increase an area of contact of the abutment section 3222 with a supporting element 50 such as a wall (FIG. 7) in use.

Figure 6:
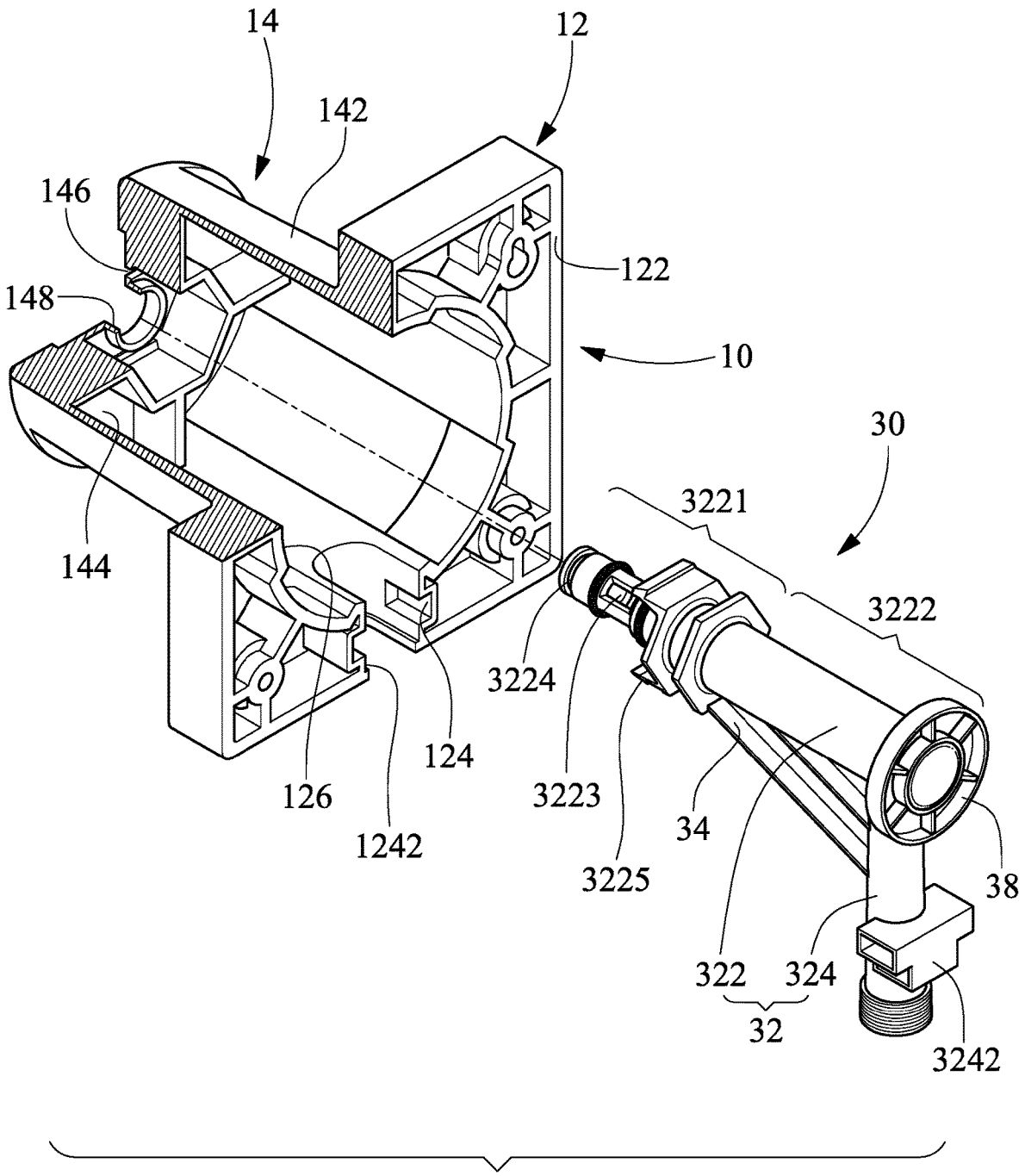
FIG. 6 is a partial view of the hose-reeling apparatus shown in FIG. 2.
Figure 7:
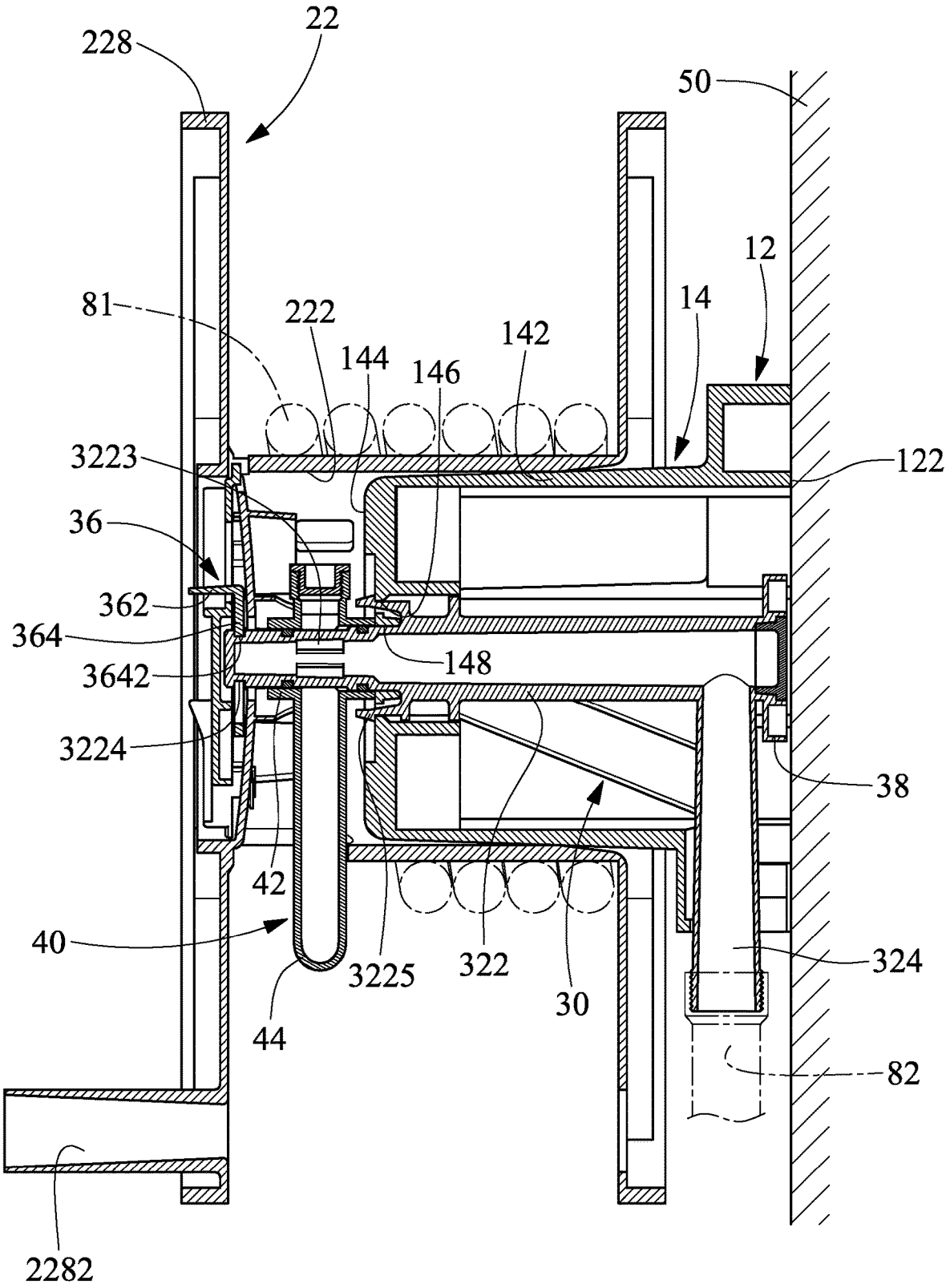
FIG. 7 is a cross-sectional view of the hose-reeling apparatus shown in FIG. 1.
Figure 8:
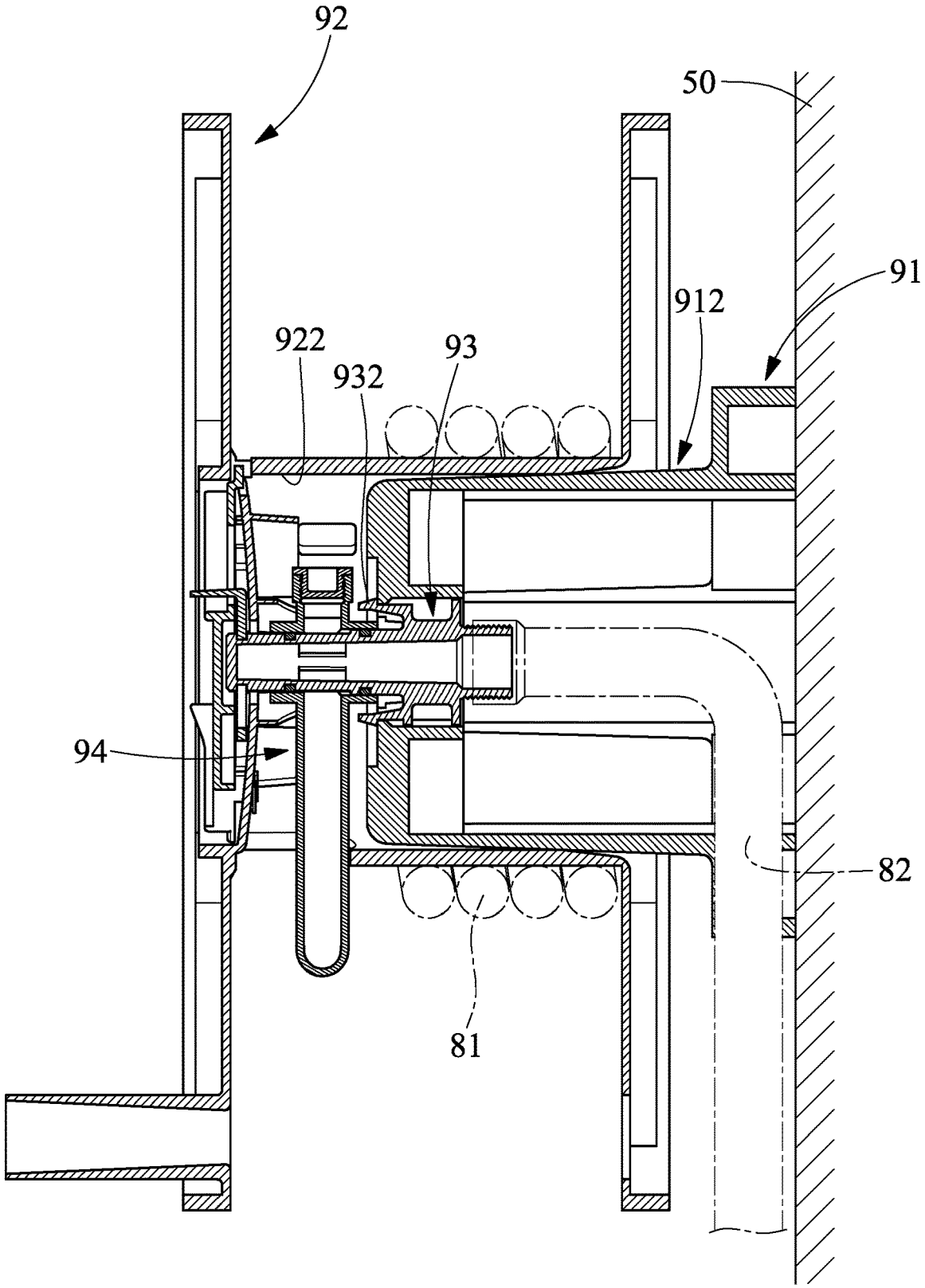
FIG. 8 PRIOR ART
FIG. 8 is a cross-sectional view of a conventional hose-reeling apparatus.

Referring to FIGS. 4 and 6, the vertical tube 324 is formed with a dovetail 3242. The dovetail 3242 is inserted in the dovetail recess 124 so that a section of the vertical tube 324 is inserted in the peripheral aperture 1242 of the plate 12. Now, the insertion section 3221 is inserted in the central aperture 148 (FIG. 7).

An end of the reinforcing element 34 is connected to the horizontal tube 322. Another end of the reinforcing element 34 is connected to the vertical tube 324. Preferably, the reinforcing element 34 is made in one piece with the horizontal tube 322 and the vertical tube 324.

Figure 5:
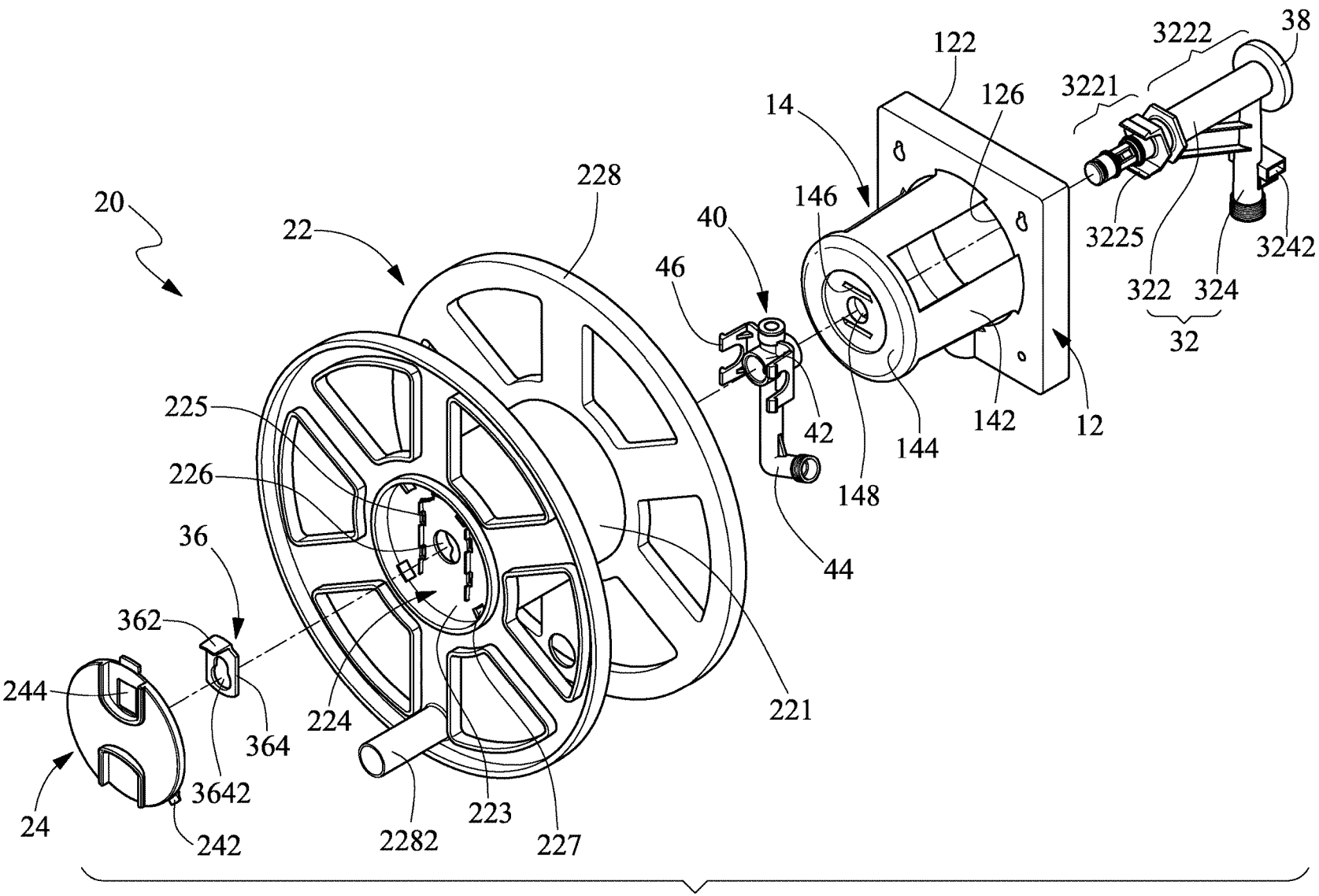
FIG. 5 is another exploded view of the hose-reeling apparatus shown in FIG. 1.

Referring to FIG. 5, the shackle 36 includes a maneuver portion 362 and locking portion 364. The maneuver portion 362 and the locking portion 364 are made in one piece and extend perpendicular to each other. The maneuver portion 362 extends throughout the window 244 of the decorative cover 24 in use. The locking portion 364 includes an aperture 3642. The insertion section 3221 of the conduit 32 extends throughout the aperture 3642 in use (FIG. 7). The aperture 3642 includes a wide portion and a narrow portion. A diameter of the wide portion of the aperture 3642 is larger than a diameter of the insertion section 3221. The maneuver portion 362 is maneuverable to move the locking portion 364 between a releasing position and a locking position in use. In the releasing position, the shackle 36 allows a free end of the insertion section 3221 of the conduit 32 to extend throughout the wide portion of the aperture 3642. In the locking position, an arched edge of the narrow portion of the aperture 3642 is inserted in the annular groove 3224 of the insertion section 3221 to keep the insertion section 3221 in position.

Referring to FIG. 5, the communication element 40 is formed with a collar 42, a tube 44 and four hooks 46 for example. The collar 42, the tube 44 and the hooks 46 are made in one piece. The collar 42 and the tube 44 intersect each other. Two fins (not numbered) extend from two opposite sides of the tube 44. Two of the hooks 46 extend from one of the fins at the right angle. The other hooks 46 extend from the other fin at the right angle.

In use, the collar 42 is located on and around the insertion section 3221 and inserted in the tubular body 221. The collar 42 is co-central with the central aperture 148 of the disc 144 of the base 10 and the central aperture 226 of the reel 22 of the reel assembly 20.

The tube 44 extends to the exterior of the tubular body 221 from the interior of the tubular body 221 through the peripheral bore 229. Then, the tube 44 is connected to the hose 81, which is wound on and around the tubular body 221.

The hooks 46 are inserted in the slots 225, thereby keeping the communication element 40 in position relative to the reel 22.

Advantageously, the base 10 and the conduit assembly 30, which is inserted in the base 10, are both connected to the supporting element 50 for example. Thus, both the rear face 122 of the base 10 and the abutment section 3222 of the conduit assembly 30 are abutted against the supporting element 50, and the conduit 32 of the conduit assembly 30 is connected to a source pipe 82 through the vertical tube 324.

In use, the axle 14 is inserted in the axial passageway 222 of the reel 22 of the reel assembly 20. Then, the reel 22 is moved toward the plate 12 of the base 10. As the axle 14 matches the axial passageway 222, the collar 42 of the communication element 40, which is inserted in the reel 22, can be located on and around the of the insertion section 3221 of the conduit 32. Advantageously, the conduit 32 is directly abutted against the supporting element 50. Hence, a force exerted on the reel 22 to move the reel 22 onto the axle 14 is transferred to the supporting element 50 via the conduit 32, without any risk of disengaging the conduit 32 from the axle 14.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hose-reeling apparatus comprising:

a base comprising:

a plate configured to engage a supporting element, the plate comprising a peripheral aperture; and an axle extending from the plate and comprising an end disc, at least one slot in the end disc, and a central aperture in the end disc;

a reel assembly supported on the axle;

a conduit assembly comprising:

a conduit inserted in the base and comprising:

a horizontal tube comprising:

an insertion section at a first end of the horizontal tube, the insertion section extending throughout the central aperture of the axle and comprising at least one peripheral aperture and at least one hook inserted in the slot of the end disc; and an abutment section at a second end of the horizontal tube opposite the first end, the abutment section comprising a contact plate configured to engage the supporting element; and a vertical tube extending from the horizontal tube and through the peripheral aperture of the plate; and a shackle movable on the reel assembly between a releasing position disengaged from the insertion section and a locking position engaged with the insertion section; and a communication element disposed in the reel assembly and covering the peripheral aperture of the insertion section as the reel assembly is supported on the axle.

2. The hose-reeling apparatus according to claim 1, wherein the plate comprises a dovetail recess in communication with the peripheral aperture, and the vertical tube comprises a dovetail inserted in the dovetail recess.

3. The hose-reeling apparatus according to claim 1, wherein the conduit assembly comprises a reinforcing element coupled between the horizontal tube and the vertical tube.

4. The hose-reeling apparatus according to claim 1, wherein the reel assembly comprises a reel comprising:

a tubular body for supporting a hose;

an axial passageway for receiving the axle;

an end disc at an end of the axial passageway;

a central aperture in the end disc to receive at least a portion of the insertion section; and two annular flanges formed on the tubular body to keep the hose on the tubular body.

5. The hose-reeling apparatus according to claim 4, wherein the reel further comprises a peripheral bore in the tubular body and in communication with the axial passageway, and the communication element comprises a collar located on and around the insertion section and a tube intersecting the collar and inserted in the peripheral bore of the reel.

6. The hose-reeling apparatus according to claim 4, wherein the reel further comprises at least one slot in the end disc, and the communication element comprises at least one hook inserted in the slot of the reel to lock the communication element to the reel.

7. The hose-reeling apparatus according to claim 4, wherein the reel assembly comprises a cover connected to the reel to cover the end disc of the reel.

8. The hose-reeling apparatus according to claim 7, wherein the reel further comprises peripheral apertures in the end disc, and the cover comprises buckles respectively inserted in the peripheral apertures of the reel to lock the cover to the end disc of the reel.

9. The hose-reeling apparatus according to claim 1, wherein the insertion section comprises an annular groove in an external face, and the shackle comprises a portion for insertion in the annular groove of the insertion section to lock the conduit to the axle.

10. The hose-reeling apparatus according to claim 9, wherein the shackle comprises an aperture with an edge for insertion in the annular groove of the insertion section to lock the conduit to the axle.

11. The hose-reeling apparatus according to claim 10, wherein the aperture of the shackle comprises a wider portion through which at least a portion of the insertion section is inserted, and a narrower portion with an edge for insertion in the annular groove of the insertion section to lock the conduit to the axle.

12. The hose-reeling apparatus according to claim 1, wherein the axle further comprises cantilevers formed between the plate and the end disc.

* * * * *